US012173969B2

(12) United States Patent
Lin

(10) Patent No.: US 12,173,969 B2
(45) Date of Patent: Dec. 24, 2024

(54) SEPARATE CAPILLARY VAPOR CHAMBER STRUCTURE FOR DUAL HEAT SOURCES

(71) Applicant: TAIWAN MICROLOOPS CORP., New Taipei (TW)

(72) Inventor: Chun-Hung Lin, New Taipei (TW)

(73) Assignee: TAIWAN MICROLOOPS CORP., New Taipei (TW)

( * ) Notice: Subject to any disclaimer, the term of this patent is extended or adjusted under 35 U.S.C. 154(b) by 204 days.

(21) Appl. No.: 18/098,722

(22) Filed: Jan. 19, 2023

(65) Prior Publication Data

US 2024/0200879 A1 Jun. 20, 2024

(30) Foreign Application Priority Data

Dec. 16, 2022 (TW) ..... 111148594

(51) Int. Cl.
*F28D 15/04* (2006.01)
*F28D 15/02* (2006.01)

(52) U.S. Cl.
CPC ..... *F28D 15/046* (2013.01); *F28D 15/0266* (2013.01)

(58) Field of Classification Search
CPC ..... F28D 15/046; F28D 15/0266; F28D 15/0233; F28F 1/126
USPC ..... 165/104.26
See application file for complete search history.

(56) References Cited

U.S. PATENT DOCUMENTS 8,985,197 B2 * 3/2015 Wang ..... H01L 23/427 165/170
10,345,049 B2 * 7/2019 Sun ..... F28D 15/0275
10,605,540 B2 * 3/2020 Tseng ..... F28D 15/046
11,421,940 B2 * 8/2022 Liu ..... F28D 15/0233
11,421,942 B2 * 8/2022 Kume ..... F28D 15/0233
11,454,454 B2 * 9/2022 Liu ..... F28D 15/04
11,511,377 B2 * 11/2022 Hulse ..... H01L 23/427
(Continued)

FOREIGN PATENT DOCUMENTS

CN 116558340 A * 8/2023
TW 202041823 A 11/2020
(Continued)

OTHER PUBLICATIONS

Office Action dated Jun. 5, 2023 of the corresponding Taiwan patent application No. 111148594.

*Primary Examiner* — Jon T. Schermerhorn, Jr.

(74) *Attorney, Agent, or Firm* — Chun-Ming Shih; HDLS IPR SERVICES

(57) ABSTRACT

A separate capillary vapor chamber structure for dual heat sources is provided for transferring heat between low and high heat sources, and includes lower and upper plates covering each other, an evaporation area having the low and high heat sources, a first condensation area extended from a side of the evaporation area and adjacent to the low heat source, a second condensation area extended from another side of the evaporation area and adjacent to the high heat source. The lower plate has a lower capillary layer extended from the first condensation area to an end of the second condensation area through the evaporation area, and the upper plate has an upper capillary layer extended from an end of the first condensation area into the evaporation area to form a cut edge, such that the upper capillary layer is shorter than the lower capillary layer.

10 Claims, 5 Drawing Sheets

(56) References Cited

U.S. PATENT DOCUMENTS

| | | | | |
|---|---|---|---|---|
| 11,547,017 | B2 * | 1/2023 | Uchino | H05K 7/2039 |
| 2010/0243212 | A1 * | 9/2010 | Meyer, IV | F28D 15/04 165/104.26 |
| 2015/0027668 | A1 * | 1/2015 | Yang | H05K 7/20336 165/104.21 |
| 2015/0055300 | A1 * | 2/2015 | Hsieh | G06F 1/20 165/104.26 |
| 2015/0083372 | A1 * | 3/2015 | Yang | H01L 23/427 165/104.21 |
| 2017/0082378 | A1 * | 3/2017 | Wang | F28D 15/04 |
| 2019/0271510 | A1 * | 9/2019 | Yang | F28D 15/0275 |
| 2020/0355445 | A1 * | 11/2020 | Chen | H01L 23/3675 |
| 2023/0012170 | A1 * | 1/2023 | Lin | H01L 23/427 |

FOREIGN PATENT DOCUMENTS

| | | | |
|---|---|---|---|
| TW | 202229802 | A | 8/2022 |
| TW | M642325 | U | 6/2023 |

* cited by examiner

SEPARATE CAPILLARY VAPOR CHAMBER STRUCTURE FOR DUAL HEAT SOURCES

BACKGROUND OF THE DISCLOSURE

Technical Field

The technical field relates to a heat transfer element, and more particularly relates to a separate capillary vapor chamber structure for dual heat sources.

Description of Related Art

As the computer industry develops rapidly, a computer with internal electronic components not only generates more heat sources due to the factor of high-performance operations or functions, but also increases the number of internal electronic components in order to handle various different processing. For example, more electronic heat sources such as graphics processing units (GPUs) are included in computer motherboards to provide higher video quality, in addition to the central processing unit (CPU) used to be its core.

However, the related-art vapor chambers designed in various shapes according to different heat dissipation requirements are added to the heat sinks to provide further heat dissipation for the aforementioned heat sources. In addition to providing a contact for multiple heat sources, it is also necessary to cooperate with the configured position to design a vapor chamber with the shape or geometry to give way in order to avoid configuration conflicts with other peripherals. Therefore, the vapor chamber not only needs to be thinned, but has shape and design often limited by applications, such that the interior of the vapor chamber serving as a space for vaporizing or liquefying a working fluid has been greatly hindered.

In the related-art vapor chamber used for dual heat sources, the temperature of heat generated by each heat source is not necessarily the same, and the flow rate of the internal working fluid after vaporization is also affected by the different temperature, thus resulting in a different flow rate of the working fluid. For example, when a heat source with a relatively higher temperature is generated, the working fluid affected by the heat source has a faster flow rate after vaporization, and the flow rate from the evaporation area to the condensation area is also faster, and the working fluid that returns to a liquid-state has a greater impact during reflow. On the contrary, the heat source with a relatively lower temperature has little impact on the above issue. This problem may cause the vapor chamber to be unable to effectively maximize its overall heat transfer efficiency, and the side with a higher temperature is prone to the existing "dry burning" issue, which may even affect the thermal cycle efficiency of the other side with a lower temperature.

In view of the aforementioned problems, the discloser proposed this disclosure based on his expert knowledge and elaborated researches to overcome the problems of the related art.

SUMMARY OF THE DISCLOSURE

Therefore, the objective of this disclosure is to provide a separate capillary vapor chamber structure for dual heat sources, which reduces the configuration area of the upper capillary structure in the limited space of the vapor chamber, so as to increase the space for circulating the working fluid in the high-temperature vaporization to retard its flow rate to avoid the backflow of the liquefied working fluid.

In order to achieve the aforementioned and other objectives, the present disclosure discloses a separate capillary vapor chamber structure for dual heat sources which is provided for transferring heat for a low heat source and a high heat source, and the separate capillary vapor chamber structure for dual heat sources includes: a lower plate, having a lower capillary layer disposed on an inner side of the lower plate; and an upper plate, covering the lower plate, and having an upper capillary layer disposed on an inner side of the upper plate; the lower plate and the upper plate cover each other to define a hollow interior, an evaporation area corresponding to the low heat source and the high heat source, a first condensation area extended from one side of the evaporation area and adjacent to the low heat source, and a second condensation area extended from another side of the evaporation area and adjacent to the high heat source, and the evaporation area and the first and second condensation areas are all in a tapering manner; the lower capillary layer of the lower plate is extended from the first condensation area to an end of the second condensation area through the evaporation area, and the upper plate is extended from an end of the first condensation area to the evaporation area to form a cut edge, such that the length of the upper capillary layer is smaller than the length of the lower capillary layer.

DETAILED DESCRIPTION

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
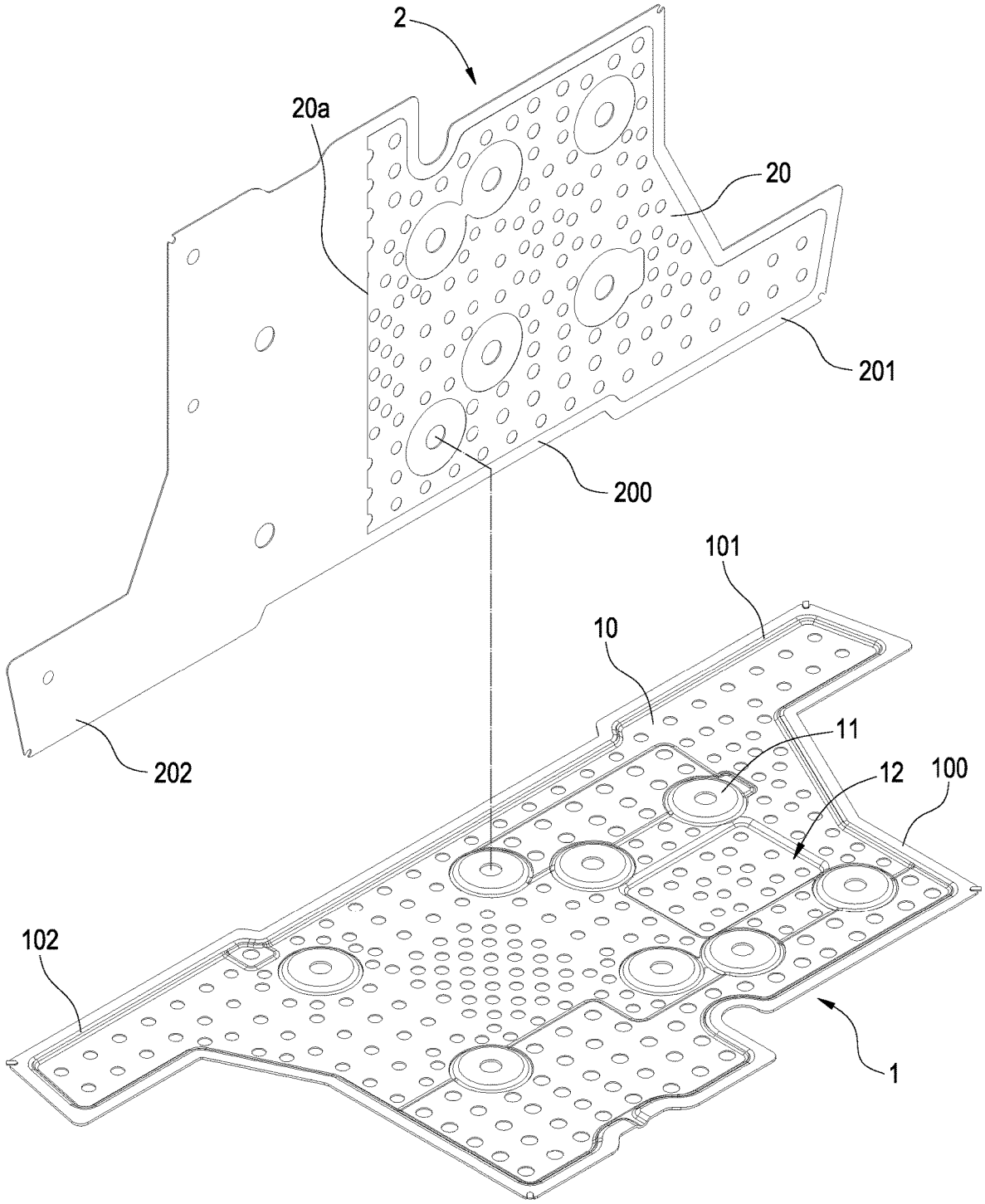
FIG. 1 is a three-dimensional exploded view of this disclosure.
Figure 2:
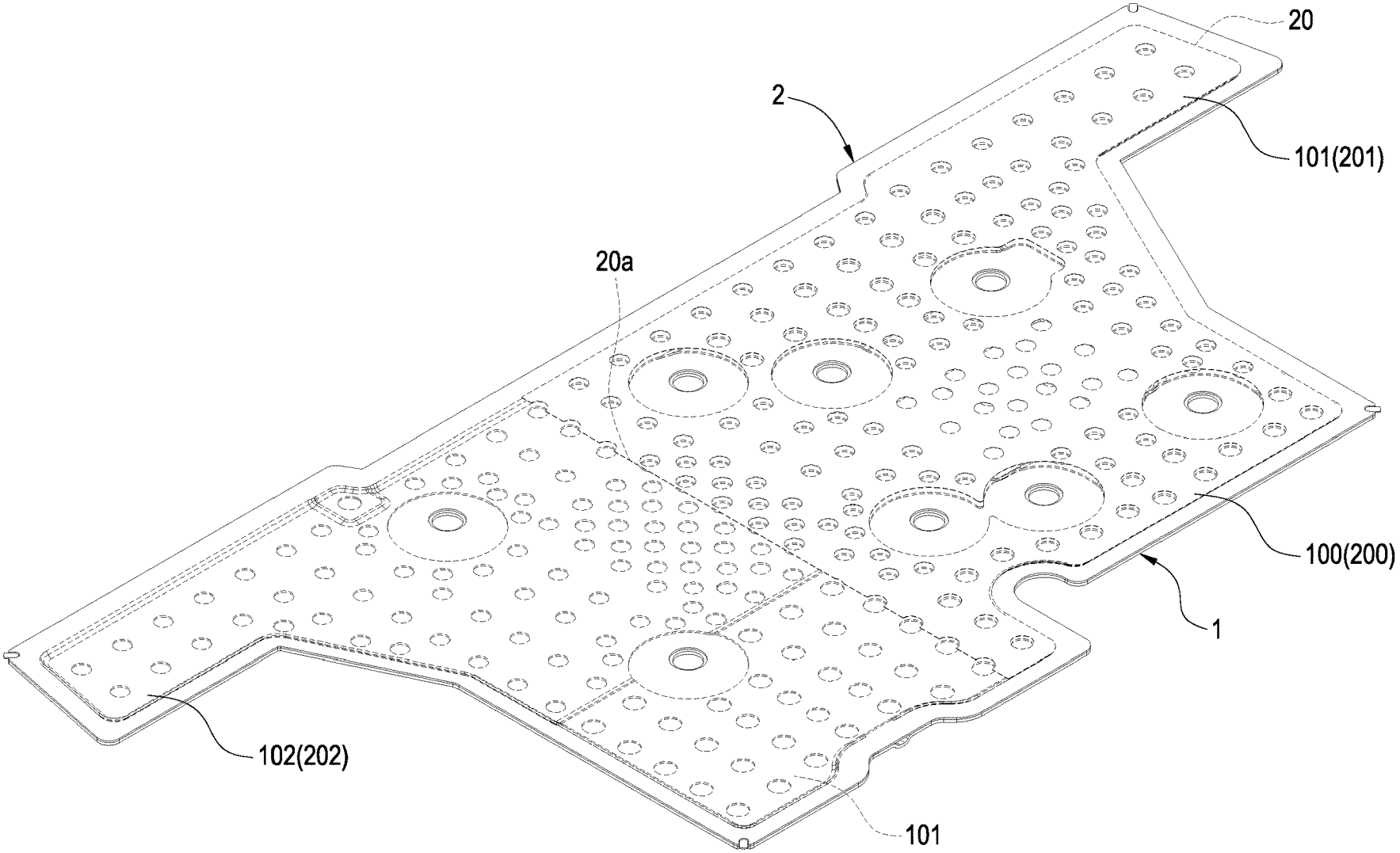
FIG. 2 is a schematic perspective view of this disclosure.
Figure 3:
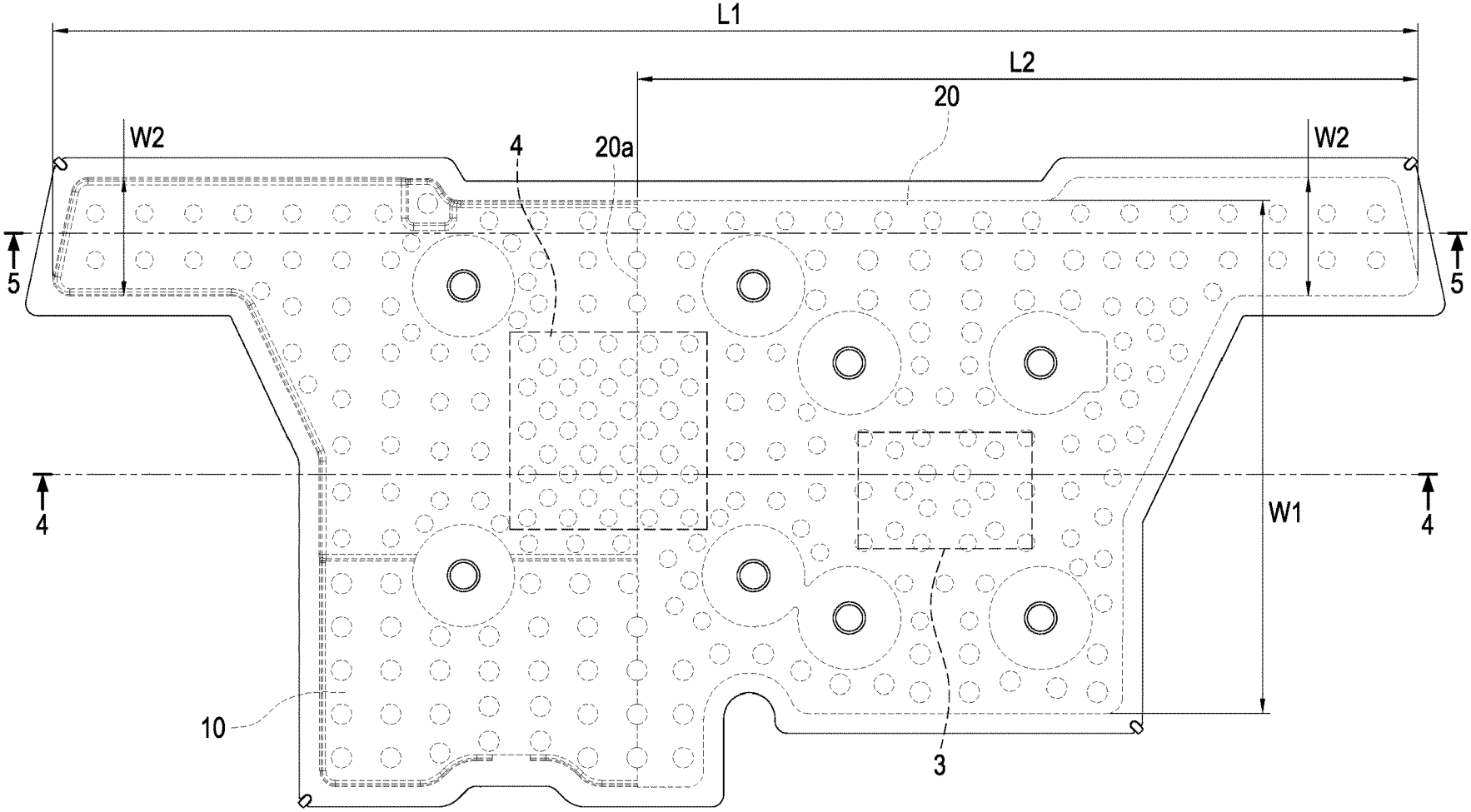
FIG. 3 is a schematic plan view of this disclosure.

With reference to FIGS. 1, 2 and 3 for the three-dimensional exploded view, the schematic perspective view and the schematic plan view of this disclosure respectively, this disclosure provides a separate capillary vapor chamber structure for dual heat sources, which includes a lower plate 1 and an upper plate 2 covering each other to define a hollow interior of each other, and the lower plate 1 has a lower capillary layer 10 disposed on an inner side of the lower plate 1, and the upper plate 2 has an upper capillary layer 20 disposed on an inner side of the upper plate 2. The lower capillary layer 10 and the upper capillary layer 20 are formed by woven meshes or sintered powder, or directly formed by grooves on the inner side of the lower capillary layer 10 or the inner side of the upper capillary layer 20.

The lower plate 1 has a lower evaporation part 100, and a first lower condensation part 101 and a second lower condensation part 102 extended from the lower evaporation part 100, and the first and second lower condensation parts 101, 102 are away from each other, for example, they are extended from two sides of the lower evaporation part 100 respectively. The upper plate 2 is in a geometric shape that matches the lower plate 1 for the covering, and includes an upper evaporation part 200 corresponding to the lower evaporation part 100, a first upper condensation part 201 corresponding to the first lower condensation part 101, and a second upper condensation part 202 corresponding to the second lower condensation part 102, such that after the lower plate 1 and the upper plate 2 cover each other, the interior is hollow and includes an evaporation area formed by the lower evaporation part 100 and the upper evaporation part 200, a first condensation area formed by the first lower condensation part 101 and the first upper condensation part 201, and a second condensation area formed by the second lower condensation part 102 and the second upper condensation part 202. The first condensation area and the second condensation area may provide the cooling function through fins (not shown in the figures) or other heat dissipating components. In FIG. 3, the lateral wide W1 of the evaporation area provided for extending the first and second condensation areas is greater than the width W2 corresponding to the first and second condensation areas. The area between the evaporation area and the first and second condensation areas of the vapor chamber is in a tapered form.

In an embodiment of this disclosure, the lower evaporation part 100 is indented outwardly from the inner side of the lower plate 1 (i.e., protruding from the outer surface of the lower plate 1), and a plurality of support structures 11 are disposed protrusively from the inner side of the lower plate 1, and the inner side of the upper plate 2 is a plane that covers the lower plate 1, so that each support structure 11 abuts against the inner side of the upper plate 2. The lower plate 1 and the upper plate 2 are sealed to form the evaporation area, the first condensation area and the second condensation area inside the space between the upper plate 2 and the lower plate 1.

Figure 4:
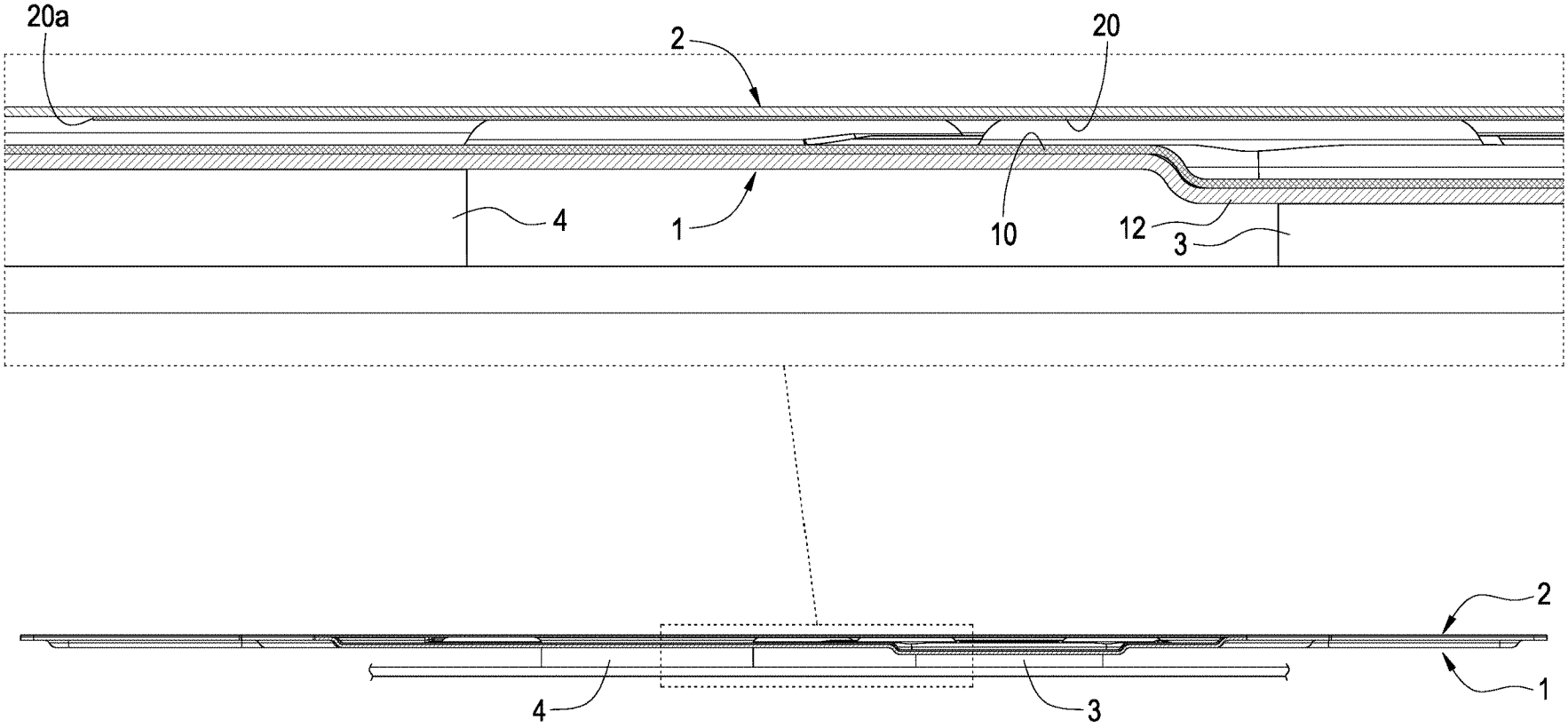
FIG. 4 is a cross-sectional view of Section 4-4 of FIG. 3.

In FIGS. 3 and 4, the vapor chamber of this disclosure is mainly used for the heat conduction of dual heat sources. The dual heat sources may be a low heat source 3 and a high heat source 4, such as the central processing unit (CPU) and the graphics processing unit (GPU) installed on a computer motherboard respectively. In other words, the low heat source 3 refers to a heat source with a temperature lower than that of the high heat source 4. On the other hand, the high heat source 4 refers to a heat source with a temperature higher than that of the low heat source 3. In general, when the vapor chamber is applied to the computer motherboard, the temperature of the heat generated by the central processing unit is usually lower than that of the graphics processing unit, so that the low heat source 3 is the central processing unit and the high heat source 4 is the graphics processing unit in this embodiment, but this disclosure is not limited to such arrangement. In addition, the height of an electronic heat-generating component (or the thickness of its chip) installed on a computer motherboard may not be the same, so that a contact part 12 may be indented outwardly from the inner side of the lower plate 1 according to the condition of the low heat source 3 or the high heat source 4 to facilitate contact with the surface of the low heat source 3 of a smaller height or thickness, and the surface of the high heat source 4 may also directly contact the outer surface of the lower plate 1 as shown in FIG. 4.

Figure 5:
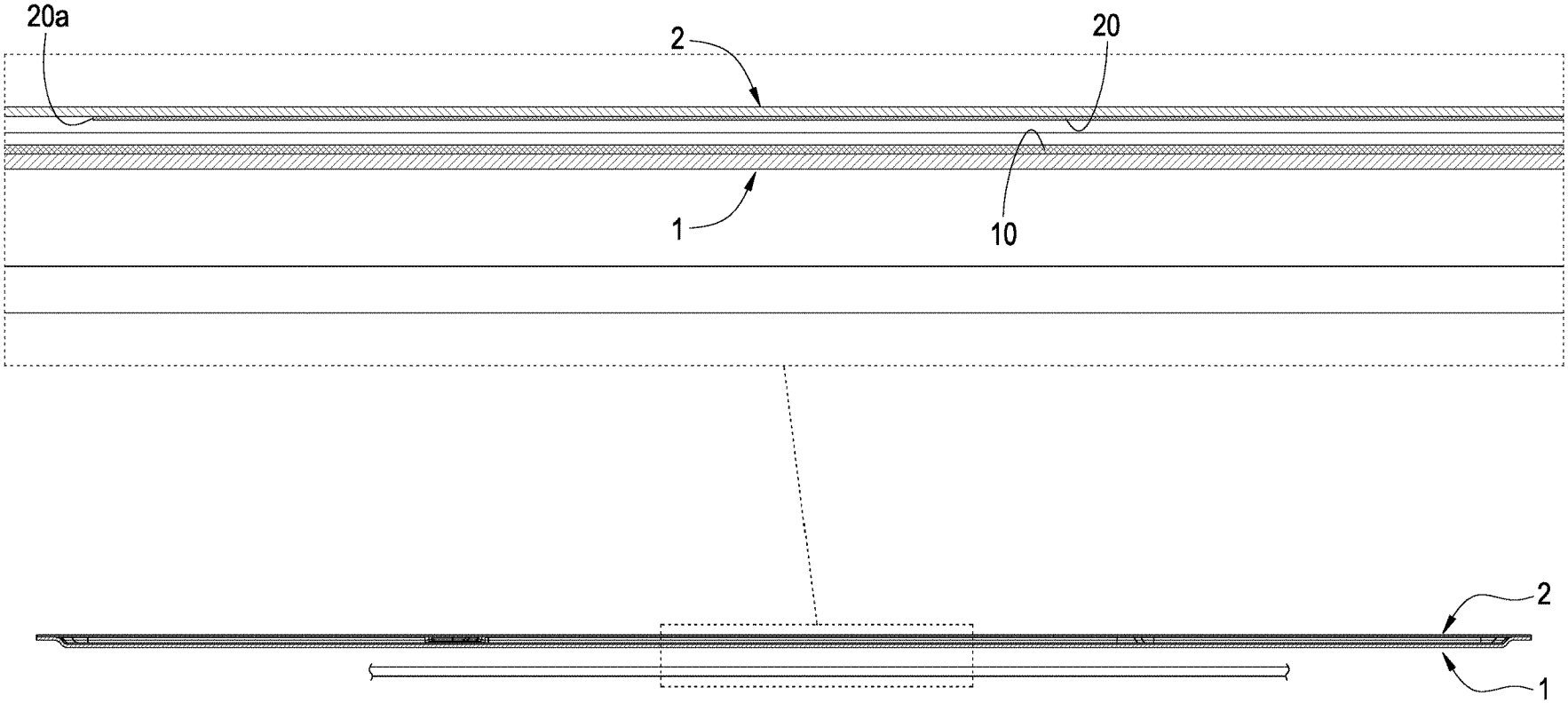
FIG. 5 is a cross-sectional view of Section 5-5 of FIG. 3.

In FIGS. 3, 4 and 5, the low heat source 3 and the high heat source 4 of this disclosure are corresponding to the positions below the evaporation area formed by the lower evaporation part 100 and the upper evaporation part 200, and the lower evaporation part 100 is provided for the contact with the low heat source 3 and the high heat source 4 separately, and the first condensation area formed by the first lower condensation part 101 and the first upper condensation part 201 is disposed adjacent to a side of the low heat source 3, and the second condensation area formed by the second lower condensation part 102 and the second upper condensation part 202 is disposed adjacent to a side of the high heat source 4. In FIG. 3, the length L1 of the inner side of the lower capillary layer 10 of the lower plate 1 is the distance measured from an end of the first lower condensation part 101 to an end of the second lower condensation part 102 through the lower evaporation part 100. The length L2 of the inner side of the upper capillary layer 20 of the upper plate 2 is the distance measured from an end of the first upper condensation part 201 and extended into the upper evaporation part 200 to form a cut edge 20*a*, and an inner side of the upper plate starting from the cut edge to an end of the second upper condensation part 202 is designed in a non-capillary structural form (namely, a capillary-free region beyond the cut edge 20*a* as shown in FIG. 1) to reduce the thickness or space of the upper capillary layer 20 occupied in the second condensation part and some of the evaporation parts. In some embodiments, viewing from a top-down projection direction, the cut edge 20*a* passes through a position above the high heat source 4 (as shown in FIG. 3) after the upper capillary layer 20 covers the low heat source 3, and the difference (L1−L2) between the length L2 of the upper capillary layer 20 and the length L1 of the lower capillary layer 10 may be adjusted according to the temperature of the heat generated by the low heat source 3 and the high heat source 4. For a greater temperature difference, the position of the cut edge 20*a* may be deviated toward the low heat source 3. For a smaller temperature difference, the position of the cut edge 20*a* may be deviated toward the high heat source 4. In short, the cut edge 20*a* may also be positioned between the low heat source 3 and the high heat source 4 (not shown in the figures).

By the composition of the aforementioned assemblies, the separate capillary vapor chamber structure for dual heat sources of this disclosure is obtained In FIGS. 3 to 5, the length of the upper capillary layer 20 of the upper plate 2 is only extended to the upper evaporation part 200 to form the cut edge 20*a*, so that the evaporation area of the vapor chamber is corresponding to the interior of the high heat source 4, and the space (or the height and thickness) may be greater than that of the low heat source 3, and more space is provided for flowing the vaporized working fluid to retard its flow rate. In the meantime, the second condensation part 202 of the upper plate 2 does not have any capillary structure, and thus more space is provided for the flow of the vaporized working fluid to prevent its flow direction being reverse to the flow direction of the liquefied working fluid and affect the backflow effect. In this way, the low heat source 3 on the side with a lower temperature may be used to balance the heat transfer efficiency of the internal phase change cycle of the vapor chamber, so that the vapor chamber may also maximize the overall heat transfer efficiency and avoid the "dry burning" problem occurred on the other side with a higher temperature.

In summation of the description above, this disclosure surely achieves the expected objectives, overcomes the drawbacks of the related art, and complies with the patent application requirements, and thus is duly filed for patent application.

While this disclosure has been described by means of specific embodiments, numerous modifications and variations could be made thereto by those skilled in the art without departing from the scope and spirit of this disclosure set forth in the claims.

What is claimed is:

1. A vapor chamber structure, transferring heat for a low heat source and a high heat source, the vapor chamber structure comprising:

a lower plate, comprising a lower capillary layer disposed on an inner side thereof; and an upper plate, covering the lower plate, and comprising an upper capillary layer disposed on an inner side thereof;

wherein, the lower plate and the upper plate cover each other to define a hollow interior, an evaporation area corresponding to the low heat source and the high heat source, a first condensation area extended from one side of the evaporation area and adjacent to the low heat source, and a second condensation area extended from another side of the evaporation area and adjacent to the high heat source, and taper regions are formed between the evaporation area and the first condensation area and between the evaporation area and the second condensation area respectively; and wherein, the lower capillary layer of the lower plate is extended from the first condensation area to an end of the second condensation area through the evaporation area, the upper capillary layer of the upper plate is extended from an end of the first condensation area to the evaporation area to define a cut edge, and a length of the upper capillary layer is smaller than a length of the lower capillary layer.

2. The vapor chamber structure according to claim 1, wherein the lower capillary layer and the upper capillary layer respectively comprise a woven mesh, a sintered powder, and a groove.

3. The vapor chamber structure according to claim 1, wherein the lower plate comprises a lower evaporation part, and a first lower condensation part and a second lower condensation part extended from the lower evaporation part, the upper plate comprises an upper evaporation part corresponding to the lower evaporation part, a first upper condensation part corresponding to the first lower condensation part, and a second upper condensation part corresponding to the second lower condensation part, the evaporation area is defined by the lower evaporation part and the upper evaporation part, the first condensation area is defined by the first lower condensation part and the first upper condensation part, and the second condensation area is defined by the second lower condensation part and the second upper condensation part.

4. The vapor chamber structure according to claim 3, wherein an inner side of the upper plate starting from the cut edge to an end of the second upper condensation part is in a non-capillary structural form.

5. The vapor chamber structure according to claim 3, wherein the lower evaporation part is indented outwardly from an inner side of the lower plate, and the lower plate comprises a plurality of support structures disposed protrusively from the inner side thereof and abutting against the inner side of the upper plate.

6. The vapor chamber structure according to claim 5, wherein the lower plate comprises a contact part indented outwardly from the inner side thereof.

7. The vapor chamber structure according to claim 1, wherein a lateral width of the evaporation area for the first condensation area or the second condensation area to be extended is greater than a width corresponding to the first condensation area or the second condensation area.

8. The vapor chamber structure according to claim 1, wherein the first condensation area and the second condensation area are away from each other.

9. The vapor chamber structure according to claim 1, wherein the upper capillary layer covers the low heat source viewing from a top-down projection direction, and the cut edge passes through a position above the high heat source viewing from a top-down projection direction.

10. The vapor chamber structure according to claim 1, wherein the upper capillary layer covers the low heat source viewing from a top-down projection direction, and the cut edge is located between the low heat source and the high heat source viewing from a top-down projection direction.

* * * * *